United States Patent [19]

McIntyre et al.

[11] Patent Number: 4,893,808

[45] **Date of Patent: * Jan. 16, 1990**

[54] EXERCISE APPARATUS FOR THE NECK

[76] Inventors: Donald R. McIntyre, P.O. Box 23, Polks Landing, Chapel Hill, N.C. 27514; Paul J. Hollahan, 109 Turnage Ridge Rd., Chapel Hill, N.C. 27514; James A. Sawhill, 408 N. Hayes, Moscow, Id. 83843

[ * ] Notice: The portion of the term of this patent subsequent to Mar. 1, 2005 has been disclaimed.

[21] Appl. No.: 148,665

[22] Filed: Jan. 26, 1988

[51] Int. Cl.[4] ..... A63B 23/00

[52] U.S. Cl. ..... 272/94; 272/129; 272/130; 272/134

[58] Field of Search ..... 272/94, 93, 96, 125, 272/129, 130, 131, 132, 134, 136, 142; 128/28 R

[56] References Cited

U.S. PATENT DOCUMENTS

| | | | |
|---|---|---|---|
| 3,495,824 | 2/1970 | Cuinier | 272/134 X |
| 3,869,121 | 3/1975 | Flavell | 272/129 |
| 4,066,259 | 1/1978 | Brentham | 272/94 |
| 4,235,437 | 11/1980 | Run et al. | 272/129 X |
| 4,278,249 | 7/1981 | Forrest | 272/94 |
| 4,354,676 | 10/1982 | Ariel | 272/129 |
| 4,452,447 | 6/1984 | Lepley et al. | 272/130 X |
| 4,462,252 | 7/1984 | Smidt et al. | 272/134 X |
| 4,650,183 | 3/1987 | McIntyre | 272/130 X |
| 4,655,450 | 4/1987 | Rodgiers, Jr. et al. | 272/94 |
| 4,702,108 | 10/1987 | Amundsen et al. | 272/125 X |
| 4,727,860 | 3/1988 | McIntyre | 272/130 X |
| 4,733,859 | 3/1988 | Kock et al. | 272/130 X |
| 4,768,779 | 9/1988 | Oehman, Jr. et al. | 272/94 |

OTHER PUBLICATIONS

Advertisement for "The Super Neck Developer", In Coach & Athlete, 1979.

Advertisement for "The Total Neck Developer", In the Athletic Journal 5-1979, p. 43.

The "4—Way Neck Machine", In the Nautilus Instruction Manual 6-1979.

Advertisement for "The Roughneck", In Coach & Athlete, 11-1981.

*Primary Examiner*—Richard J. Apley
*Assistant Examiner*—Robert W. Bahr

[57] ABSTRACT

A neck exercise apparatus which allows movement about three machine axes which correspond to the cervical axes of flexion/extension, lateral flexion and rotation. Selective resistance to movement about each axis may be provided and torque, position and velocity measurements made with respect to neck movement performance against the resistance.

14 Claims, 2 Drawing Sheets

EXERCISE APPARATUS FOR THE NECK

DESCRIPTION

1. Technical Field

This invention relates to an exercise apparatus for the neck, and more particularly to an apparatus of the type operable by human user movements against predetermined resistance. The apparatus of the invention has been specifically designed to measure the functional characteristics of the cervical portion of the spinal column (more commonly called the "neck") and provides for accurate measurement of the torque and concomitant angular position and velocity during movement about the neck axes of flexion/extension, lateral flexion, and axial rotation.

2. Background Art

The use of an exercise apparatus in order to exercise for physical therapy purposes or to exercise for diagnostic and rehabilitation purposes is known. Moreover, it has recently become known to electrically connect a suitably programmed personal computer in order to better determine the functional characteristics of certain natural human joints or articulations such as the knee or ankle. A representative patent is U.S. Pat. No. 4,650,183 which issued to the assignee of the present invention and is directed to an exercise apparatus for measuring performance of the ankle joint and subtalar joint in the ankle and foot of a user. Also, U.S. Pat. application Ser. No. 871,514 which is owned by the assignee of the present invention is directed to a knee exercise apparatus to measure the functional characteristics of the knee joint, and said assignee now has perfected and makes and sells an exercise apparatus under the trademark ISOSTATION B-200 which measures tri-axial movement of the lower back.

With specific reference to neck related apparatus, a neck exercise apparatus is known to be manufactured under the registered trademark NAUTILUS. This device is believed to be exclusively a neck exercise device providing for movement of the neck against a dead weight force. U.S. Pat. No. 4,528,990 teaches an apparatus for measuring movement of the head or spine about a vertical axis and is also adapted to indicate tilting of the head. However, all neck exercise apparatus known to applicant are unsatisfactory for the purpose of analyzing the multi-axial performance of the cervical portion of the spinal articulation which is commonly called the neck. The neck exercise apparatus of the present invention allows for the documentation of angular position, velocity and torque associated with neck movement, either alone or simultaneously, about the axes of flexion/extension, lateral flexion and axial rotation of the neck.

DISCLOSURE OF THE INVENTION

In accordance with the present invention, applicant provides a new neck exercise apparatus designed to measure the functional characteristics of the cervical spine or neck. Accurate measurement of the torque generated in each of the three primary axes of movement of the neck flexion/extension, lateral flexion, and rotation, during either dynamic or isometric testing, as well as velocity and positional information during dynamic testing of the neck are achieved by positively aligning the natural axes of the neck so as to be substantially coaxial with the pivotable axes of movement provided for by the neck exercise apparatus of the invention.

The instant invention is of a novel construction which accommodates tri-axial and simultaneous movement of the neck about the natural neck axes of flexion/extension, lateral flexion and rotation. A predetermined and independent resistance to movement can be selected for each of the three axes of movement of the neck. Alternatively, any or all of the aforementioned three axes of neck movement may be locked in order for the apparatus to accommodate static or isometric testing of movement about a selected axis or axes of neck movement.

Therefore, it is a primary object of the present invention to improve the accuracy and precision by which the functional characteristics of neck movement performance are measured. In realizing this objective, an apparatus is provided having the ability to measure, either simultaneously or selectively, neck movement about all three natural axes of pivotable movement.

Another object of the present invention is to provide a new apparatus of novel construction which is capable of monitoring the torques and concomitant angular positions and velocity changes associated with neck movement about the axes of flexion/extension, lateral flexion and axial rotation.

A further object of the present invention is to provide a new apparatus of novel construction which may be adapted for either isometric or static testing of neck movement about one or more of the axes of flexion/extension, lateral flexion, and rotation movement of the neck.

A still further object of the present invention is to provide a neck exercise and performance evaluation apparatus adapted for simultaneous pivotal movement about three machine axes which correspond to and are coaxial with the natural neck axes of flexion/extension, lateral flexion and rotation movement, and which allows for independent resistance to motion to be selected for each of the three machine axes.

BRIEF DESCRIPTION OF THE DRAWINGS

Some of the objects of the invention having been sated, other objects will appear as the description proceeds, when taken in connection with the accompanying drawings, in which.

BEST MODE FOR CARRYING OUT THE INVENTION

While the present invention will be described hereinafter with particular reference to the accompanying drawings, in which a certain operating embodiment of the apparatus of the present invention is shown, it is to be understood at the outset of the description which follows that it is contemplated that apparatus in accordance with the present invention may be varied from the specific form described hereinafter, while still attaining the desired result of this invention. Accordingly, the description which follows is to be understood as a broad teaching disclosure directed to persons of appropriate skill in the appropriate arts, and not as limiting upon the scope of this invention.

Figure 1:
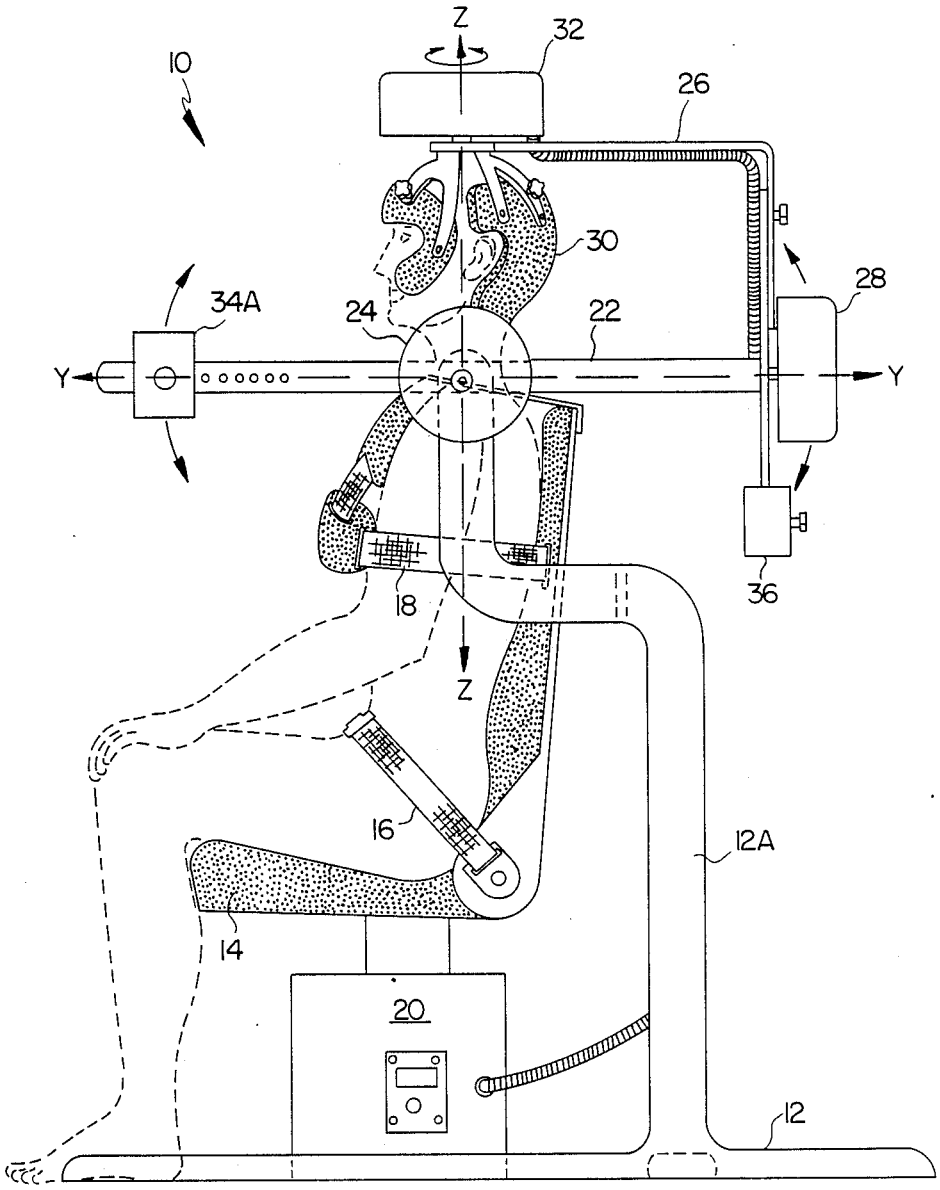
FIG. 1 is a side elevation view of the neck exercise apparatus of the invention with a user positioned thereon.
Figure 2:
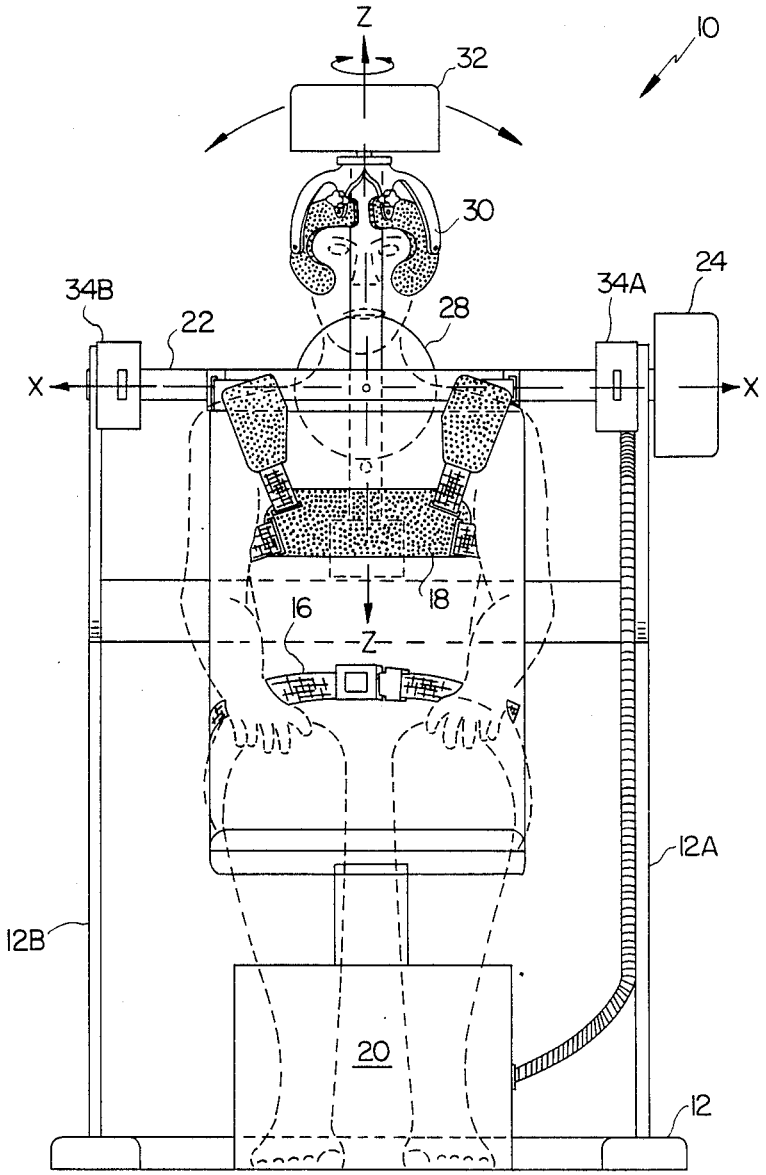
FIG. 2 is a front view of the neck exercise apparatus of FIG. 1 with a user positioned thereon.

Referring now to FIGS. 1 and 2, a neck exercise apparatus embodying the present invention is there illustrated and generally designated 10. Neck exercise apparatus 10 comprises a stationary frame 12 which supports a seat 14 having a pelvic restraint 16 and thoracic restraint 18 attached thereto for securing a user (shown in phantom lines) to seat 14. A cabinet 20 supports seat 14 and houses the hydraulic and electrical circuitry (not shown) of apparatus 10 as well as a conventional 3-way seat adjustment mechanism providing for vertical, front-to-back and side-to-side adjustment of seat 14 relative to frame 12. As can be seen in FIGS. 1 and 2, frame 12 includes two generally upwardly extending posts 12A, 12B positioned in opposing relationship on each side of seat 14. Posts 12A, 12B and cabinet 20 are secured to frame 12 of neck exercise apparatus 10.

A U-shaped gimbal 22 is pivotably mounted at the medial portion of one arm to post 12A and at the medial portion of the other arm to post 12B. Gimbal 22 is mounted to frame 12 so that the arms thereof extend alongside and outwardly from a user positioned on seat 14. A hydraulic actuator 24 is connected to U-shaped gimbal 22 where gimbal 22 is pivotably mounted to post 12A. Hydraulic actuator 24 is utilized to provide selective resistance to user neck movement about the axis of flexion/extension of the neck which is coaxial with machine axis X of pivotable movement of U-shaped gimbal 22 on posts 12A, 12B. An inverted "L" shaped support member 26 is pivotably mounted at one end to the medial portion of the back of U-shaped gimbal 22 so as to extend generally vertically upwardly therefrom and laterally over the head of a user positioned in seat 14 of neck exercise apparatus 10. A second hydraulic actuator 28 is secured to support member 26 where it is pivotably mounted to U-shaped gimbal 22 so as to provide selective resistance to user movement about machine axis Y (see FIG. 1) which is coaxial with the axis of lateral flexion. Actuator 28 therefore serves to provide a predetermined and selective resistance to movement of a user's neck about the axis of lateral flexion which is independent of the predetermined resistance provided by actuator 24 to movement about the neck axis of flexion/ extension.

An adjustable helmet 30 is rotatably attached to support member 26 immediately above the head of a user so that the machine axis of rotation Z will be coaxial with the rotational axis of the cervical spine or neck. A third hydraulic actuator 32 is secured to the rotatable shaft of helmet 30 in order to provide a predetermined and selective resistance to movement of a user's neck about the Z axis of rotation which is independent of the predetermined resistance provided by actuator 28 to movement about the Y axis and actuator 24 to movement about the X axis.

Although resistance to movement about axes X, Y and Z has been described above as provided by hydraulic actuators 24, 28 and 32, it is contemplated that other suitable resistance means could be utilized including electromagnetic means, friction brake means, and pneumatic resistance means.

Applicant contemplates providing torque and position transducers and velocity measuring means in cooperative association with each axis of movement, in addition to the aforementioned hydraulic actuators, in order to provide the necessary performance measurements of torque, angular movement and velocity about each of axes X, Y and Z. Although a matter of design choice, strain gauges, pneumatic transducers or analogue gauges could be utilized to provide the required measurement of torque about each of the three natural axes of neck movement. Potentiometers could be utilized as the position transducers to measure angular movement, and velocity of movement about each of the three axes could be measured utilizing conventional electronic and/or numerical computation means as a matter of design choice. Cabinet 20 described hereinbefore contains the control means for independently selecting the resistance to movement about the axes of flexion/extension, lateral flexion and rotation of the cervical spine or neck but, alternatively, the resistances may be selected with an electrically connected personal computer as discussed in more detail hereinbelow.

The position of the user is controlled by proper adjustment of seat 14 which includes an adjustment mechanism in cabinet 20 (not shown) for coaxial alignment of the machine axes (X, Y and Z) with the natural cervical axes by motorized adjustment. Also, support member 26 is adjustable in vertical length to accommodate user's having different length necks. The objective of adjusting seat 14 and support member 26 is to assure that machine axes X, Y and Z are in perfect coalignment with the natural cervical axes of flexion/extension, lateral flexion and rotation.

Apparatus 10 includes counterweights 34A and 34B on U-shaped gimbal 22 and counterweight 36 on support member 26 which may be adjusted in order to assure that the entire neck exercise assembly when secured to a user is gravity independent so that measurements of neck movement about axes X, Y and Z will accurately reflect neck performance and not be influenced by the weight of the apparatus utilized to measure movement about the axes. Finally, it should be appreciated that applicant contemplates that U-shaped gimbal 22, support member 26 and helmet 30 may be pivotably locked by any suitable means in order to provide for isometric or static performance testing of the neck at substantially any orientation. Although there would not be an angular position or velocity to measure for any locked axis of neck movement, the torque exerted against that particular axis could be measured in order to provide desired isometric testing data.

In operation, neck exercise apparatus 10 requires that a user be seated on seat 14. Next, the user is secured to seat 14 with pelvic restraint 16 and thoracic restraint 18. Helmet 30 is then fastened to the head of the user after any necessary adjustment is made to support member 26 to accommodate the length of the neck of the user. After the user is tentatively positioned on exercise apparatus 10, seat 14 is carefully adjusted so that the user's neck axes of flexion/extension, lateral flexion and pivotal rotation correspond to the X, Y and Z axes of movement of apparatus 10 and are substantially coaxial therewith. With the user now properly aligned in apparatus 10, selective resistance is established to movement about the X, Y and Z axes through selective settings of hydraulic actuators 24, 28 and 32, respectively. Counterweights 34A, 34B and 36 are then adjusted to assure that the entire apparatus is gravity independent so that the neck movement measurement data will be accurate.

Although not shown in the drawings, a suitably programmed and electrically connected personal computer may be utilized with apparatus 10 in order to establish selective resistance to movement about the X, Y and Z axes and to analyze and record the pounds-feet of torque effort and the concomitant angular position and velocity changes during movement of the neck of a user about the X axis of flexion/extension, the Y axis of lateral flexion, and the Z axis of rotation in order to better determine and record functional characteristics of the neck. The computerized evaluation of the neck movement may be utilized to determine the extent of deficiency of performance of the neck due to athletic injury or other causes such as aging or disease. It should also be appreciated that the computer program could be suitably utilized to provide graphs, reports and protocols in addition to storage/retrieval and comparisons.

In conclusion, the subject invention provides for a novel tri-axial neck exercise apparatus which is capable of heretofore unavailable movement performance evaluation accuracy in view of its ability to simultaneously accommodate and evaluate multi-axial neck movement.

What is claimed is:

1. An apparatus for exercising the neck of a user and comprising:

a stationary frame having two upwardly extending posts;

an adjustable seat secured to said frame for positioning a user between said two posts;

a neck exercise assembly pivotably mounted to said posts and including a pivotably movable Ushaped support member having an arm extending forwardly and rearwardly on each side of a user positioned in said seat, and an adjustable length inverted L-shaped member extending generally upwardly therefrom for securing the head of a user, said U-shaped support member being pivotably movable relative to said frame about a horizontal axis which corresponds to an axis of rotation which is coaxial with the axis of flexion/extension movement of the neck, and said adjustable length inverted L-shaped member for securing the head being pivotably movable relative to said U-shaped support member about an axis of rotation which is generally perpendicular to said horizontal axis and coaxial with the axis of lateral flexion movement of the neck;

a head engagement pivotably mounted to said adjustable length inverted L-shaped member for securing the head, said head engagement device being adjustable relative to said U-shaped support member and pivotably movable relative to said inverted L-shaped member about a vertical axis which is generally perpendicular to said horizontal axis and coaxial with the axis of rotation movement of the neck;

first resistance means operatively connected to and cooperating with said U-shaped support member of said neck exercise assembly for resisting flexion-/extension movement of the neck of a user;

second resistance means operatively connected to and cooperating with said inverted L-shaped member of said neck exercise assembly for resisting lateral flexion movement of the neck of a user;

third resistance means operatively connected to and cooperating with said head engagement device for resisting rotational movement of the neck of a user;

a counterweight operatively secured to said U-shaped support member;

a counterweight operatively secured to said inverted L-shaped member; and restraint means for securing the user to said seat during exercise of the neck;

whereby said neck exercise assembly and said head engagement device carried thereby permit simultaneous multi-axial pivotal movement of the neck about its natural axes, said adjustable seat and adjustable inverted L-shaped member for securing the head allowing for coalignment of the axes of rotation of the exercise apparatus with the natural cervical axes of flexion/extension, lateral flexion and rotation, and said counterweights rendering the exercise assembly gravity independent.

2. An apparatus according to claim 1 including means for measuring torque, angular positional movement and angular velocity operatively connected to said U-shaped support member.

3. An apparatus according to claim 1 including means for measuring torque, angular positional movement and angular velocity operatively connected to said inverted L-shaped member for securing the head of a user.

4. An apparatus according to claim 1 including means for measuring torque, angular positional movement and angular velocity operatively connected to said head engagement device.

5. An apparatus according to claims 2, 3 or 4 including an electrically associated computer for analyzing performance of the neck of a user during flexion/extension, lateral extension and rotational movement.

6. An apparatus according to claim 5 wherein said computer independently and selectively controls the resistance to movement about each of said axes of movement.

7. An apparatus according to claim 1 wherein said head engagement device comprises an adjustable helmet.

8. An apparatus according to claim 1 wherein said first resistance means comprises a hydraulic rotary actuator.

9. An apparatus according to claim 1 wherein said second resistance means comprises a hydraulic rotary actuator.

10. An apparatus according to claim 1 wherein said third resistance means comprises a hydraulic rotary actuator.

11. An apparatus according to claim 1 wherein said axes of flexion/extension movement, lateral flexion movement and rotational movement of the neck are all substantially mutually perpendicular.

12. An apparatus according to claim 1 wherein said restraint means comprises thoracic and pelvic restraints for securing a user of said apparatus.

13. An apparatus according to claim 1 comprising means to independently select the resistance to be provided by said first, second and third resistance means to flexion/extension movement, lateral flexion movement and rotational movement, respectively, of the neck of a user.

14. An apparatus according to claim 13 including means to selectively prevent pivotal movement by at least one of said U-shaped support member, inverted L-shaped member and head engagement device to facilitate isometric exercise of the neck about at least one of the corresponding axes of flexion/extension movement, lateral flexion movement and rotational movement of the neck of a user.

* * * * *